US009380819B2

(12) United States Patent
Saville et al.

(10) Patent No.: US 9,380,819 B2
(45) Date of Patent: Jul. 5, 2016

(54) EVERSIBLE SEALABLE GLOVE

(76) Inventors: Tara J. Saville, Kailua Kona, HI (US); Mark D. Sale, Kailua Kona, HI (US); Jay B. Paulson, Kailua Kona, HI (US)

( * ) Notice: Subject to any disclaimer, the term of this patent is extended or adjusted under 35 U.S.C. 154(b) by 523 days.

(21) Appl. No.: 13/451,322

(22) Filed: Apr. 19, 2012

(65) Prior Publication Data

US 2012/0266356 A1 Oct. 25, 2012

Related U.S. Application Data

(60) Provisional application No. 61/478,308, filed on Apr. 22, 2011.

(51) Int. Cl.
*A41D 19/00* (2006.01)

(52) U.S. Cl.
CPC ..... *A41D 19/0075* (2013.01); *A41D 19/0048* (2013.01)

(58) Field of Classification Search
CPC ..... A47L 13/18; A41D 19/0048; A41D 19/0068; A41D 19/0072; A41D 19/0075
USPC ..... 2/16, 158, 159, 161.6, 161.7, 169; 15/227; 206/278; 383/4, 50, 55, 63, 87
See application file for complete search history.

(56) References Cited

U.S. PATENT DOCUMENTS 2,150,985 A * 3/1939 Plummer, Jr. ..... 383/89
4,034,853 A * 7/1977 Smith ..... 206/278
4,677,697 A * 7/1987 Hayes ..... 2/159
4,937,881 A * 7/1990 Heise ..... 2/16
6,203,080 B1 3/2001 Surplus
6,539,549 B1 4/2003 Peters, Jr.
7,908,673 B2 * 3/2011 Kerr-Maddox et al. ..... 2/163
2002/0088825 A1 * 7/2002 Laverdure ..... 222/107
2004/0231029 A1 11/2004 Kouri
2007/0092166 A1 * 4/2007 Anzini et al. ..... 383/63
2012/0076440 A1 * 3/2012 Gallagher ..... 383/4

FOREIGN PATENT DOCUMENTS

GB 2184997 A * 7/1987
WO 20090021268 2/2009

* cited by examiner

*Primary Examiner* — Nathan Durham
*Assistant Examiner* — Sally Haden
(74) *Attorney, Agent, or Firm* — Sean D. Burdick

(57) ABSTRACT

An eversible sealable glove has front and rear panels, each panel having a cuff portion, a sleeve portion, a hand portion, and a perimeter. The perimeter of the front panel is completely sealed to the perimeter of the rear panel. An opening is formed through the front panel between the cuff portion of the front panel and the sleeve portion of the front panel, and may be sealed by a zipping closure comprising a mating pair of female and male extrusions, wherein one of the extrusions is bonded to the cuff portion of the front panel and the other one of the extrusions is bonded to the sleeve portion of the front panel. The zipping closure is configured to allow the mating pair to seal the opening whether the glove is everted or non-everted. A method for manufacturing the glove is also disclosed.

7 Claims, 8 Drawing Sheets

EVERSIBLE SEALABLE GLOVE

RELATED APPLICATIONS

This application claims priority to U.S. Provisional Patent Application No. 61/478,308, which was filed Apr. 22, 2011, and which is fully incorporated herein by reference.

BACKGROUND

Handling and/or disposal of bacteria-ridden solid waste, from blood borne pathogens to animal excrement, presents a continuing problem of contamination. High levels of bacteria from animal excrement force closures of beaches, parks and river-fronts every year. Retrieving pest traps with injured or dead rodents, insects, lizards, birds, toads, leave the users exposed to diseases, infectious pathogens, and parasites Retrieval of dead birds, as is recommended for testing of West Nile disease, leave users at risk of contamination. Many people must regularly dispose of contaminated meat and other food products. Others clean up disaster, pandemic and accident sites, either trying to preserve items that need cleaning, or to gather evidence. Generally, the people involved wear protective gloves and place much of the solid waste into plastic bags or garbage sacks.

The receptacles used to store the waste may not close or seal properly, allowing odors and possibly fluids and pathogens to escape. Using bags that seal would help correct this problem, but would still leave the user exposed to the waste in the process of retrieval. That may result in using two elements, a glove and a bag, or trying to use a bag as a glove to gather and then seal the waste inside, which limits dexterity, and if using a zip-lock style bag would require everting the bag prior to use.

A low cost, convenient tool that protects the user from touching undesirable waste, that could contain this waste, and seal it from escaping, could be used in many applications. A combination of a light weight plastic glove for dexterity, a sleeve to act as a containment vessel and a zipping style closure system to prevent the waste from escaping, would be the most effective and convenient group of attributes for a product of this nature.

Currently, the general idea for a resealable, everting glove, with a zipper has been cycling in some form for more than a decade, but to date there are no sealable glove bags commercially available in the marketplace. There are several reasons for the non-viability in the marketplace, and a brief description of how an everting glove bag operates may help to understand why.

To make a glove/bag with a zipping-like closure mechanism function as a sanitary containment vessel the user must first don the glove, pick up the item and evert the grasped item back out the end of the glove/bag and then seal the bag with the closure mechanism. The inherent problem to date has been that when the glove bag is everted, the once mated zipping portions have rotated 180 degrees which leaves the closure extrusions opposed to each other and obviously inoperable. To remedy this final opposing positioning of the closure extrusions, one solution, shown in U.S. Pat. No. 5,704,670 Donald Neil Surplus Jan. 6, 1998, everts the entire glove prior to donning the glove. The patent states, "The use of the glove bag 10 is everted and worn over the hand as shown in FIG. 4" The effort to evert the glove is not only inconvenient and time consuming, but the actual eversion of the fingers in a light weight plastic glove is an extremely difficult task, if it can be done at all. It also risks compromising the integrity of the bag and its seal.

It should also be noted that zipping style closures are manufactured in the "sealed" position. If one were to try to evert the bag before use in the manufacturing process after the seal has been made, the following steps would need to be completed. First, one would need to open the sealed zipping closure. Second, one would need to blow or pull the glove and sleeves thru the open end to evert the bag and then finally cut the glove shape. These extra steps in the manufacturing process take more time and hence money. If this type of convenience product is to be made as a viable product for consumer use it must be done at a low cost, which for the most part translates into spending less time on the building table.

The prior art shown in U.S. Pat. No. 6,203,080 dated Mar. 20, 2001, teaches that this product must be an inexpensive product. It cites the complexities of U.S. Pat. No. 4,937,881 dated Jul. 3, 1990, U.S. Pat. No. 5,568,955 dated Oct. 29, 1996 and U.S. Pat. No. 4,645,251 dated Feb. 4, 1987. The design in the '080 patent is simple in the manufacturing process, the difficult eversion process is left to the consumer, making it much less of a "convenience product". If the eversion process were attempted to be completed in the manufacturing process, it would be take several more steps which would cost more which would compromise its commercial viability, and further, even when completed it would leave the bag in a state, where the now inverted seams resist laying in a flat position, which would create problems with handling, packing and shipping.

DETAILED DESCRIPTION

Embodiments herein for a multipurpose sanitary disposal glove incorporate a different type of seal called a "front panel" or "in-field" zip extrusion that can be adhered or bonded to a single panel of film on the sleeve portion of the glove. This sealing mechanism can be pre-attached to rolls of film prior to the glove manufacturing process. Because this seal opening is attached to only one "side" of the bag, the reversal process that allows the zipper to mate up after everting only the cuff portion prior to retrieval, is a much simpler process for the end user than would be the case with the typical zip lock style closure. It requires much less time on the machine that produces it and hence lowers to the cost to the end user or consumer, and would come to the consumer in a flat and completely sealed virgin state, which allows it to become a viable product in the marketplace.

Figure 1A:
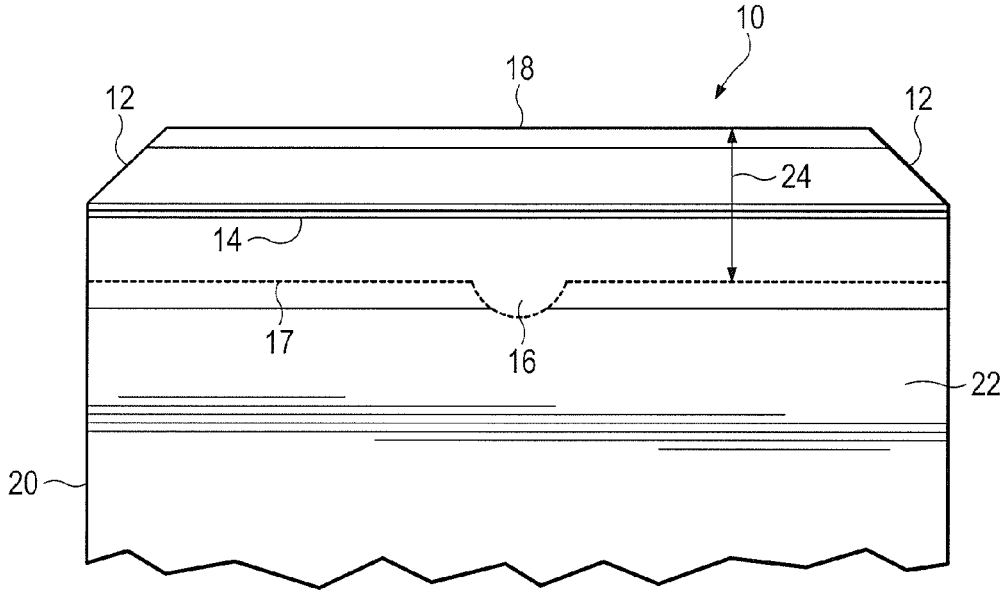
FIG. 1A shows a frontal view of an upper portion of an embodiment of an eversible sealable glove.

FIG. 1 shows an embodiment of a multipurpose sanitary disposal glove. The glove 10 has "relieved corners" such as 12. Rather than having a 90-degree angle or square corner, the corners have an angle, such as 45-degrees. As shown in FIG. 1A, relieved corner 12 may comprise a length of the perimeter that connects a sealed end 20 of the perimeter to a folded end 18 of the perimeter and may form an obtuse angle with the sealed end and with the folded end. This makes the eversion of the glove mechanically easier and with less strain on the edges. Further, the corners can be cut and sealed at the same time as the cutting and sealing of the sealed portion 20.

The zipping panel closure in this embodiment is bonded to sheet of film 22. The zipping panel closure has male and female mated extrusions 14, a perforated access 17 and a tab portion 16 of the perforated access. The user breaks the perforated access 17 at tab 16 and separates the remaining portion of the perforated access 17, exposing the male and female mated extrusion line 14. The mated portions lie inside the glove bag and the tab portion 16 allows the user to separate the mated portions as will be discussed in more detail further.

This closure system allows the product to come to the consumer flat and sealed accommodating ease in packaging and handling. In addition, the interior surfaces of the glove panels remain untouched until the perforated access is opened. As seen in prior art, where gloves are comprised of an "open end", maintaining a uniform dimension and structure would be difficult at best and hinder the handling of the product during the manufacturing process and again in the packaging process.

Once glove is fully everted, the seal 14 seals easily and is very difficult to re-enter as the flap previously used to open the seal is now everted and on the "inside" of the bag. This is an important consideration for a product where possible contaminants are enclosed, keeping them from coming in contact with other persons or the environment.

Even though the closure system is located on one side of the glove, the glove remains available for use on either the right or the left hand. The placement and orientation of the front panel closure system allows the successful operation of the glove. The tab 16 and perforated edge 17 typically work better when located between the closure seal and the finger end of the glove. While it can be located between the closure seal and the folded end 18 of the glove, it may not function as desired. Orientation in this fashion promotes ease in the press and seal process of closure.

The exterior edges of the glove remain closed until the tab 16 releases the perforation, discussed in more detail later. The glove remaining closed has the advantage of keeping it sanitary for the user, prior to use. The closed portions of the glove consist of a folded portion 18 and a sealed portion 20. Until release of the perforation, the folded portion of the glove remains sealed as well. The glove further consists of a cuff portion 24, which will become clearer in further illustrations.

A film 22 forms the glove. The film may consist of one of many different types of plastic, including, but not limited to, High-Density Polyethylene (HDPE), Medium-Density Polyethylene, (LDPE) Low-Density Polyethylene, Linear Low-Density Polyethylene (LLDPE). Alternatively, the material of the glove bag may be a non-woven material, such as plastic, rubber, various polymers, etc., woven material such as cotton, wool, nylon, etc., or any other material including non-woven materials such as spun lace or hydroentangled fibers, mechanically or chemically bound materials made of natural or man-made fibers. Generally, leak-proof material would prevent leakage of odors or fluids from whatever is contained inside the glove bag, but no limitation to the base material is intended or should be implied. Indeed in medical applications, where the glove bag may be in contact with human skin, a soft material may promote patient comfort.

Figure 1B:
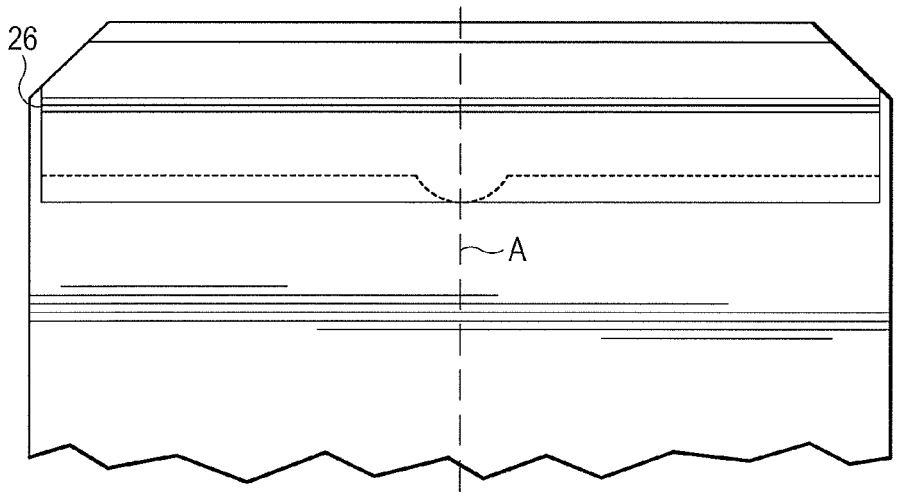
FIG. 1B shows a frontal view of an upper portion of an alternative embodiment of an eversible sealable glove.

FIG. 1B shows an embodiment of a glove where the zipping closure 26 does not extend to the perimeter of the glove. The zipping closure attaches to only the front panel of the glove and therefore is not required to reach the perimeter of the glove.

Figure 2:
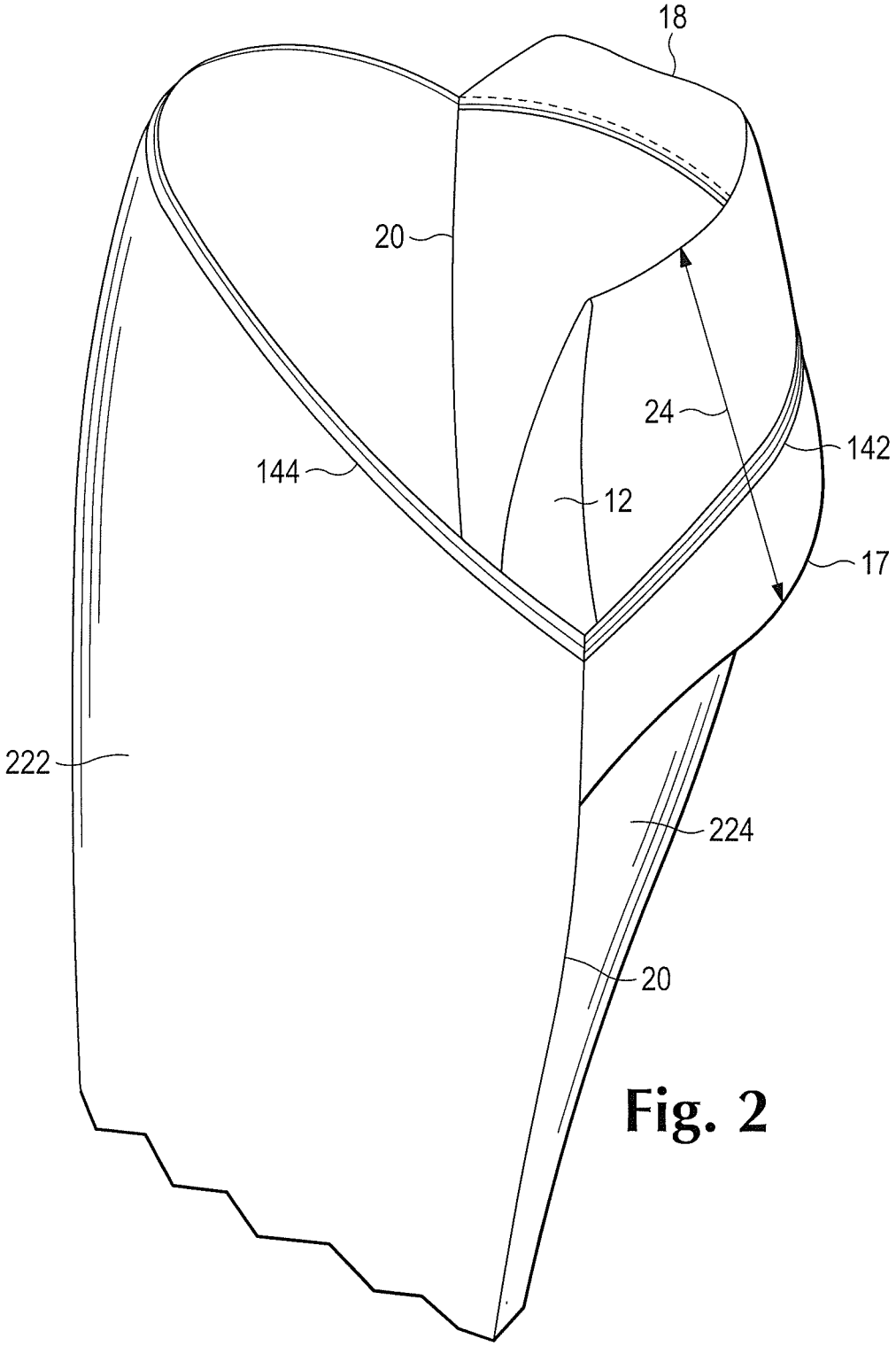
FIG. 2 shows a perspective side view of an upper portion of an embodiment of an eversible sealable glove.

FIG. 2 shows a perspective side view of the glove bag. In this view the cuff portion 24 has been released from the front panel 222 by pulling on tab 16 to release the perforation 17. Pulling further on tab 16 has broken the zipping closure 14 into female and male portions 142 and 144, respectively. From this point the cuff portion 24 would be everted over axis 18, and partially cover the cuff portion of rear panel 224. After this, the glove is ready to be donned.

Figure 3:
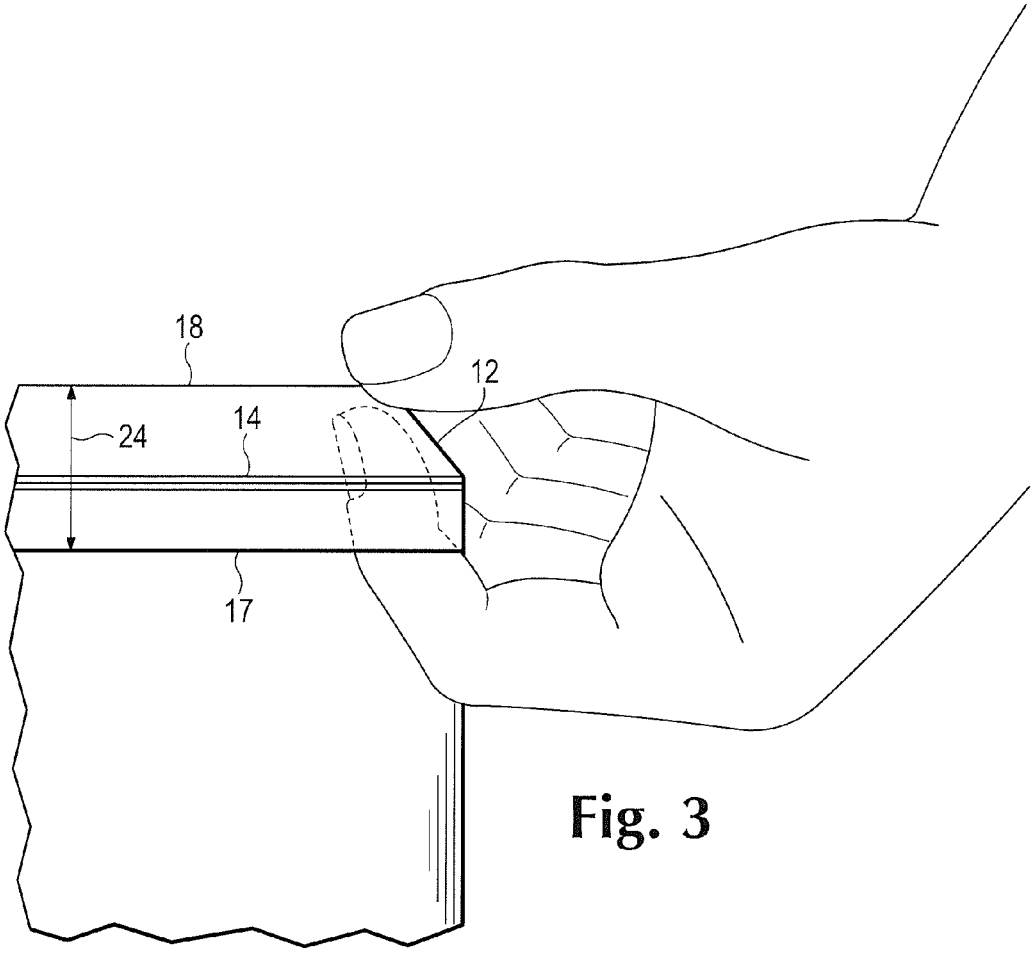
FIG. 3 shows a view of a user's hand in a cuff portion of an embodiment of an eversible sealable glove.

FIG. 3 shows a view of user inserting a finger inside the cuff portion 24. This occurs after the user has broken the perforation. Pulling the flap 16 for leverage, the seal of closure 14 is broken into 142 and 144.

Figure 4:
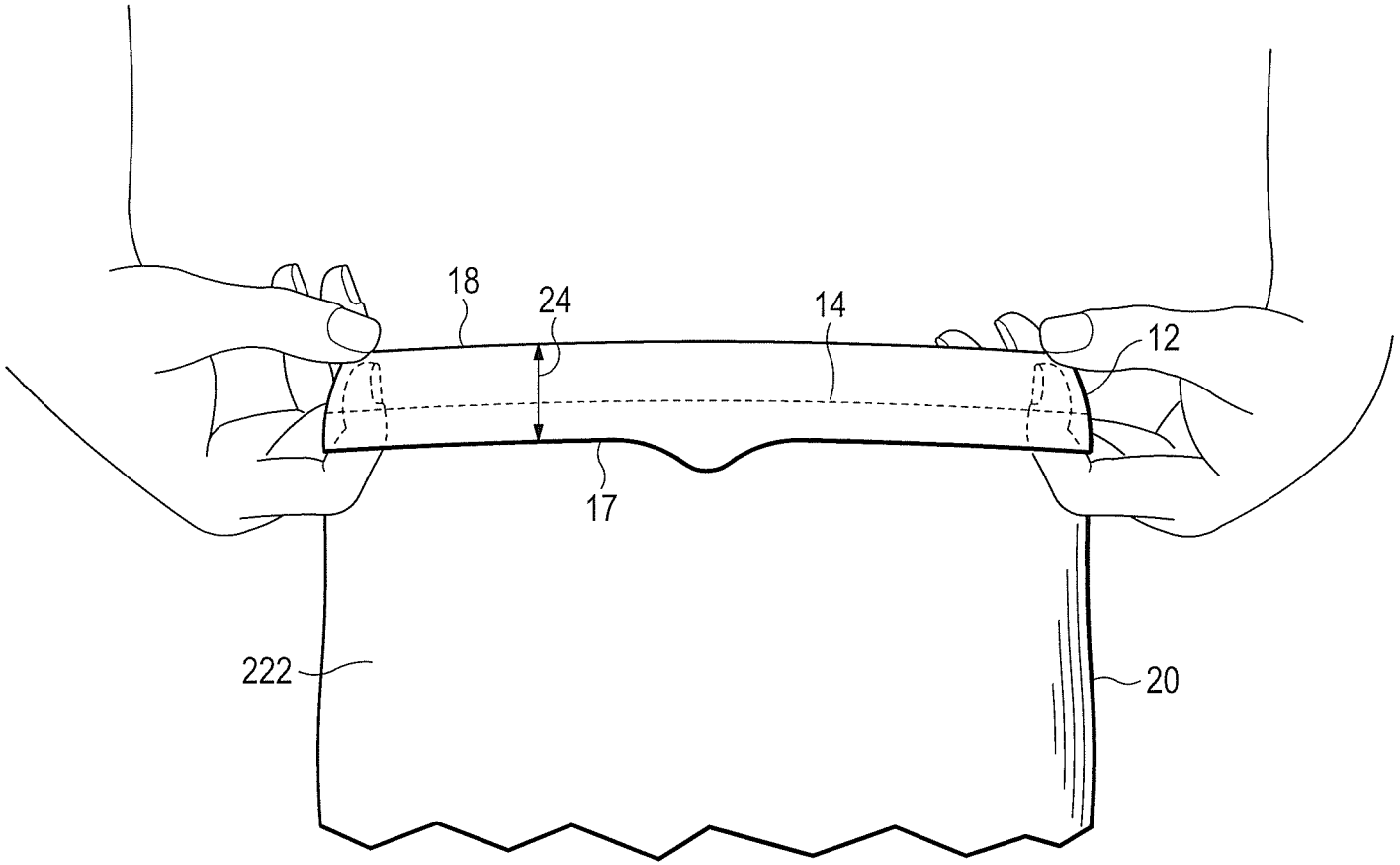
FIG. 4 shows a view of a user's hands in a cuff portion of an embodiment of an eversible sealable glove.

FIG. 4 shows the user everting the cuff portion 24 by inserting fingers into the cuff portion 24. The user would then evert the cuff portion 24 about the axis or edge 18.

Figure 5:
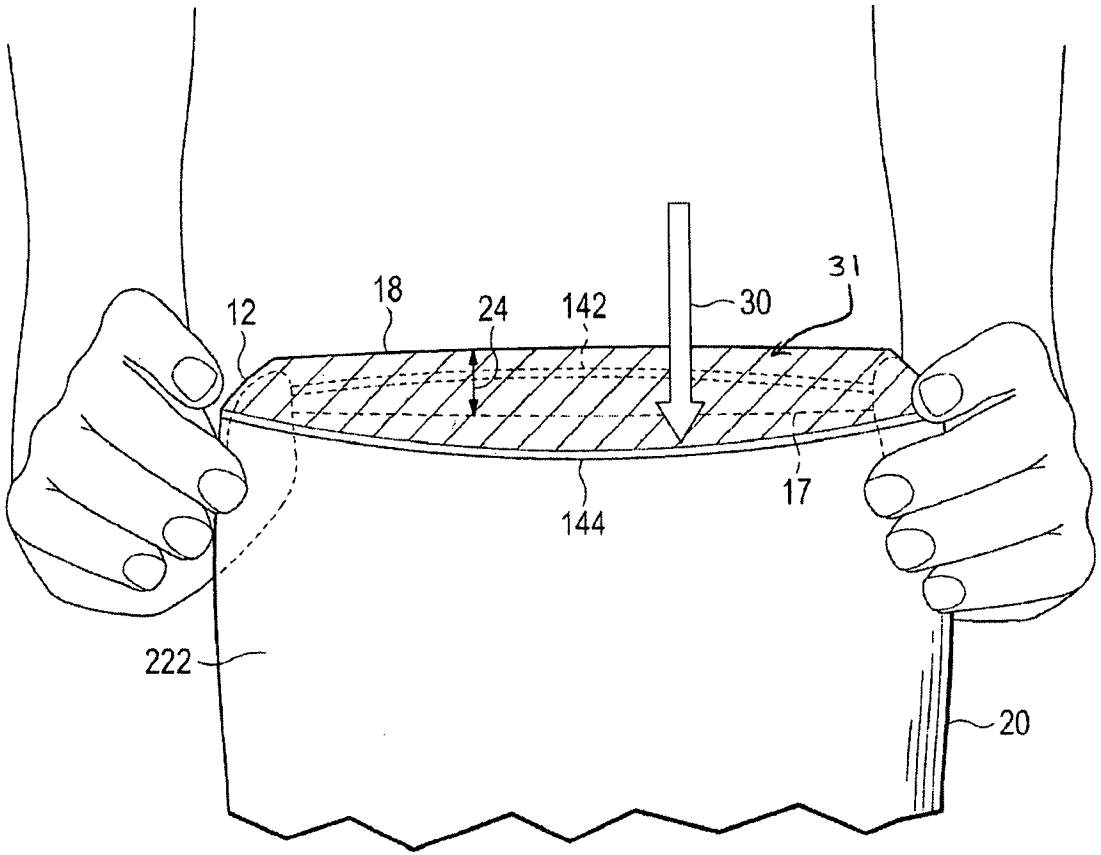
FIG. 5 shows an embodiment of an eversible sealable glove with a cuff portion everted.

FIG. 5 shows the resulting opening 31, shown as the shaded portion. The arrow 30 shows the direction of insertion. Once the cuff portion 24 has been everted a the opening 31 has formed between the folded portion and the front portion of the closure 142. The user can then insert her hand to retrieve a desired item. Once grasped the desired item can be everted back through the opening 31 which then re-aligns 142 and 144 in their "mated" configuration ready for sealing. Once sealed, closure 14 is very difficult to re-enter as tab portion 16 is now inside the bag and can no longer assist in leveraging the separation of closure 14 into 142 and 144.

Figure 6:
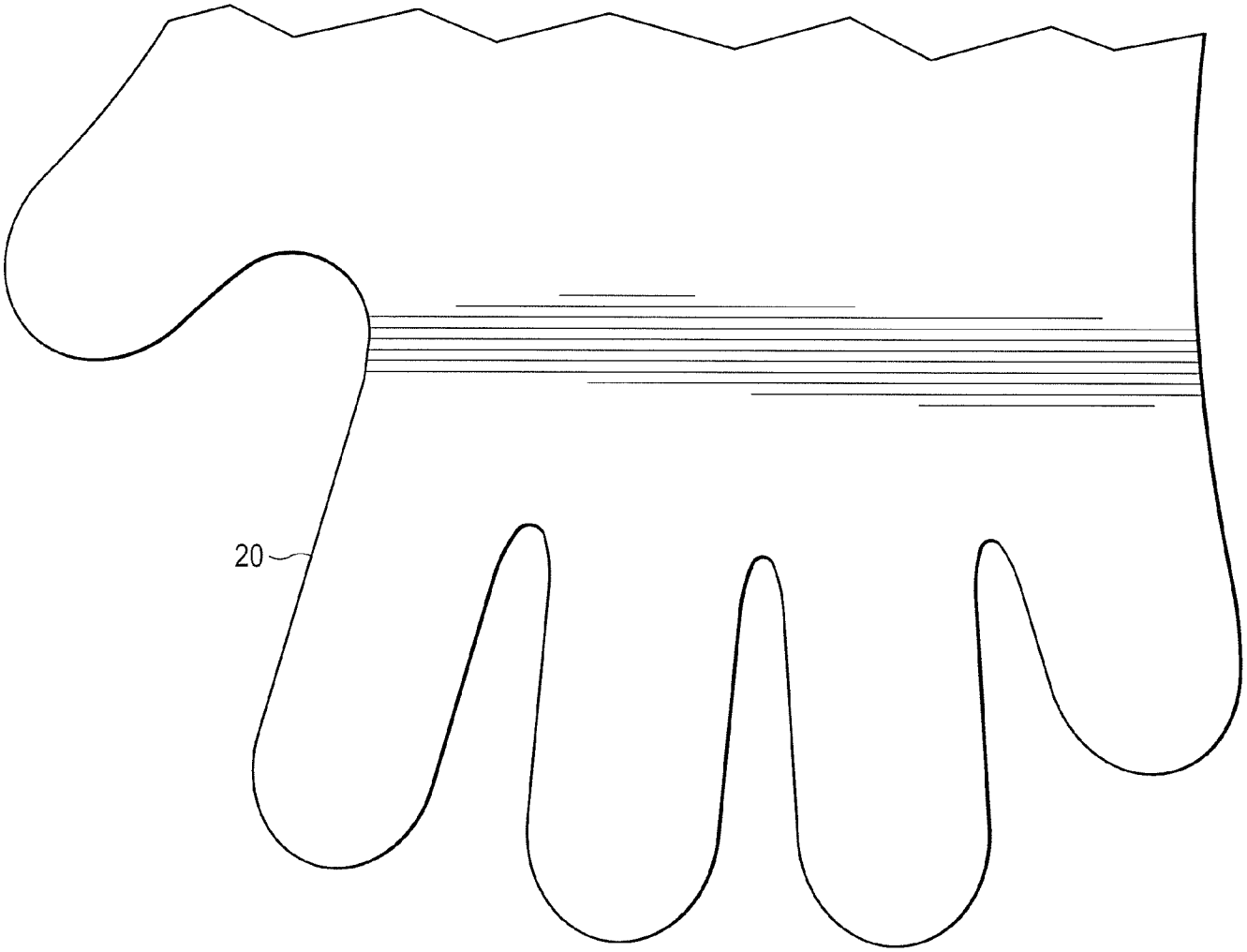
FIG. 6 shows an embodiment of a hand portion of an eversible sealable glove.

FIG. 6 shows the hand portion of the glove. This embodiment has four fingers and a thumb. However, in order to ensure the user has the ability to manipulate and grasp whatever item is of interest, the hand form portion will generally be of relatively normal size. The hand form may have different sizes, such as small, medium and large, or child and adult, etc. and oversizing to facilitate use of a second glove underneath for various special uses may also be constructed.

The hand form being of a size to allow manipulation and grasping of objects is in no way intended to limit the scope of the embodiments and no such limitation should be implied. Glove bags may have an alternative hand form. It should be noted that any feature or variation applies to all embodiments, whether shown in each figure or not. The hand form may consist of a mitten hand form. Other hand forms included may consist of a hand forms having two 'fingers,' three fingers or four fingers. The term 'finger' relative to hand forms may not actually include one finger, but more than one. The finger portion is a portion separate from the main or palm portion of the hand form.

The hand form could have raised or lined ridges for additional gripping quality. These could be applied on to the plastic prior to stamping the hand form or by way of a spray process or coating process. Other textures than lined ridges are possible, including but not limited to, dots, 'x' shapes, other geometrical shapes, etc.

Figure 7:
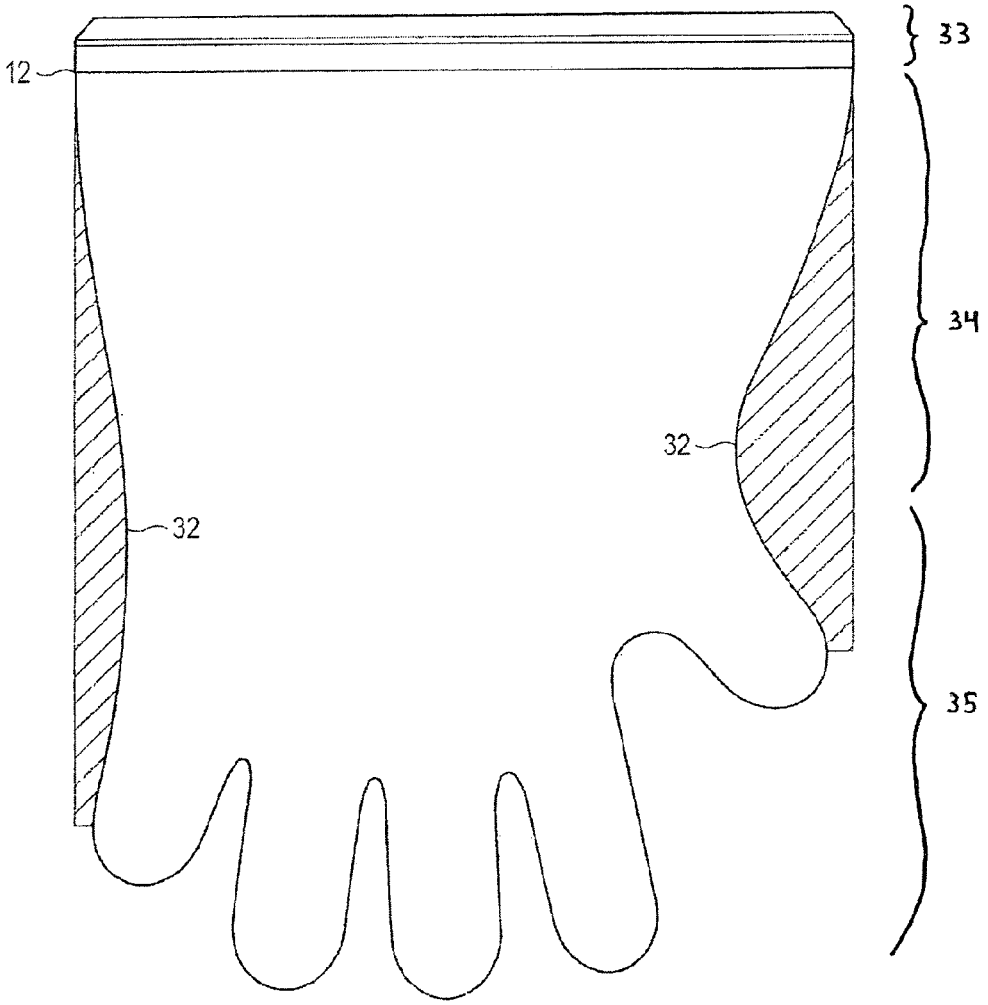
FIG. 7 shows a frontal view of an embodiment of an eversible sealable glove form having side contours.

The double closure system is available in rolls of plastic film. During manufacture the film may be cut and sealed in shapes such as the hand form shown in FIG. 6. FIG. 7 shows a frontal view of an embodiment of an eversible sealable glove having a cuff portion 33, a sleeve portion 34, and a hand portion 35. FIG. 7 shows an example of the hand form within a rectangular portion of plastic film. The contours 32 extending from the relieved edges 12 assist in the retrieval process preventing the bag from sliding off the user's hand when the user's arm is held downward, such as when picking something up off of the ground. It also lessens the binding effect of the material as the opposing thumb lowers into a grasping position, no longer in the same plane as the fingers.

During manufacture, the process cuts a perforated access on a first panel on a roll of film. The integrated, or 'sealed,' male and female extrusions are then attached to the first panel. To form the bag portion, a second panel of film is overlaid on the first panel, or the first panel is folded over to form the cuff end. Folding the first panel over to form the second panel has an advantage that the cuff portion is then seamless. The hand portion as shown in FIG. 7 can then be formed by cutting and sealing the roll of film or welding it. Each glove is then separated from the roll of film.

Figure 8:
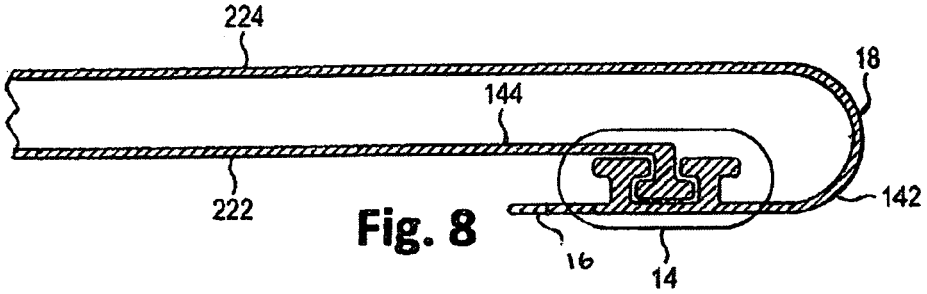
FIG. 8 shows a cross-sectional view along line A of FIG. 1B of the sleeve and cuff portion of an eversible sealable glove with female and male extrusions mated together to seal the glove in a noneverted state.

As mentioned previously, the glove bag comes to the user sealed and uncontaminated. FIG. 8 shows a cross-section of the bag of FIG. 1 along the line A. The closure 14 has a female portion 142 and a male portion 144, as previously discussed. While this particular arrangement is shown, the positions of these portions may be reversed. In FIG. 8, the bag remains in the state in which the user received it, except that the perforation 17 from FIG. 1A has been released.

Figure 9:
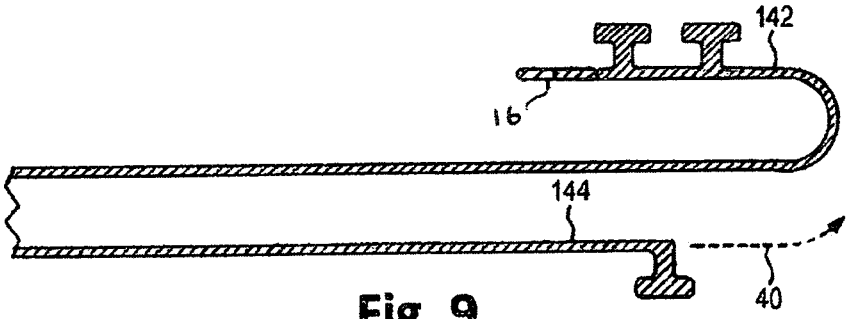
FIG. 9 shows a cross-sectional view of the glove of FIG. 8 wherein the female and male extrusions have been disengaged during an eversion of the glove.
Figure 10:
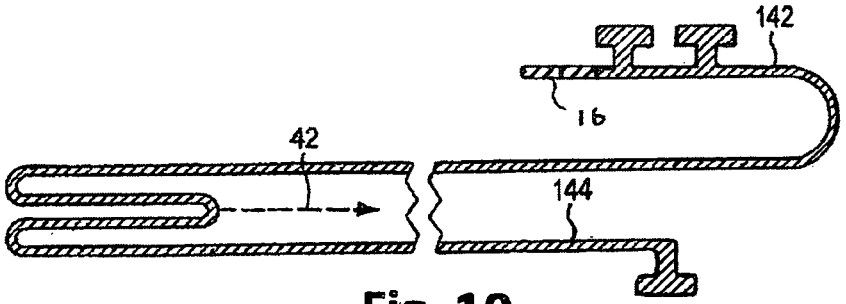
FIG. 10 shows a cross-sectional view of the cuff and hand portions of the glove of FIG. 8 wherein the hand portion has been drawn inward during an eversion of the glove.
Figure 11:
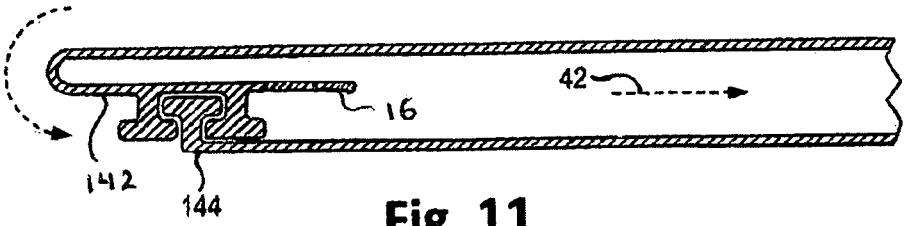
FIG. 11 shows a cross-sectional view of the hand and sleeve portions of the glove of FIG. 8 with female and male extrusions mated together to seal the glove in an everted state.

In FIG. 9, the cuff portion has been everted around the rolled edge 18 in the direction of arrow 40. The two portions of the seal 14 now both face outward. In FIG. 10, the bottom of the bag, now shown, is pulled back through the opening in the direction of arrow 42. In FIG. 11, the bottom of the bag is now oriented in the direction of arrow 42 and the two portions 142 and 144 mate up to seal whatever the user picked up inside the glove bag.

The above embodiments have several advantages over the prior art. For example, all perimeter edges are sealed which leaves the product flat which makes packaging most efficient. Because the product could then be delivered to the customer completely sealed it would ensure that the inside of the glove/bag would be in its virgin state; it has not been contaminated prior to use.

Another advantage lies in the fact that once everted with the contents inside the seal is very difficult to reopen. Current approaches designed primarily to pick up contaminates, preventing or at least hindering reopening eliminates further contamination of other persons or the environment.

Because the embodiments described here require so little extra tooling to make it, it could be produced at a lower cost than current solutions, having strong commercial viability.

The uses and applications of such a glove bag are numerous. For example, it would allow easy clean up from fish and meat preparation; allow hygienic handling of paper towels for messy and unhygienic clean up such a vomit, urine, oils, adhesives, etc.; diaper clean up and disposal; animal waste clean up and disposal; janitorial tasks such as urinal deodorizer 'mint' disposal, cigarette tray cleaning, hotel cleaning, public restroom disposal of feminine hygiene products; portable and easy clean up in all forms of public transportation; first aid applications for clean up and disposal of body fluids and debris; in daycares and hospitals; and pest control such as rat/mouse traps. Organizations that may employ such a glove bag include homes, daycares, places of business, emergency response organizations, hospitals, military entities, the World Health Organization, the Federal Emergency Management Administration, the American Red Cross, the United Nations, the Center for Disease Control, Transportation Security Administration, jails and prisons, etc.

Thus, although there has been described to this point a particular embodiment for a sealable, disposable glove, it is not intended that such specific references be considered as limitations upon the scope of this invention except in-so-far as set forth in the following claims.

What is claimed is:

1. A method of manufacturing an eversible sealable glove, comprising:

forming a front panel and a rear panel, both panels having a cuff portion, a sleeve portion, a hand portion, and a perimeter;

sealing completely the perimeter of the front panel to the perimeter of the rear panel;

forming an opening through the front panel between the cuff portion of the front panel and the sleeve portion of the front panel; and attaching to the front panel a zipping closure comprising a mating pair of female and male extrusions, by bonding one of the extrusions to the cuff portion of the front panel and by bonding the other one of the extrusions to the sleeve portion of the front panel so that when mated, the mating pair seals the opening;

wherein forming the front panel and the rear panel further comprises forming relieved corners on the cuff portions of each of the panels, wherein each relieved corner comprises a length of the perimeter that connects a sealed end of the perimeter to a folded end of the perimeter and forms an obtuse angle with the sealed end and with the folded end.

2. The method of claim 1 wherein the attaching step further comprises bonding the extrusions to the front panel to allow the mating pair to seal the opening when the glove is everted or noneverted.

3. The method of claim 1, further comprising forming the front panel and the rear panel from film.

4. The method of claim 3, wherein the film comprises a plastic selected from the group consisting of high-density polyethylene, medium-density polyethylene, low-density polyethylene, and linear low-density polyethylene.

5. The method of claim 3, wherein the film comprises one of plastic, rubber, polymers, cotton, wool, nylon, and non-woven materials.

6. The method of claim 1, wherein sealing completely the perimeter of the front panel to the perimeter of the rear panel is effected by welding.

7. The method of claim 1, wherein the sealing step further comprises creating a fold between the cuff portion of the front panel and the cuff portion of the rear panel.

* * * * *